US006033063A

United States Patent [19]

Tomikawa et al.

[11] Patent Number: 6,033,063

[45] **Date of Patent: *Mar. 7, 2000**

[54] INK PRINTER AND INK TANK WITH INK SPILL PREVENTION

[75] Inventors: Ichiro Tomikawa; Jun Takagi; Junichi Yoshida; Katsuyuki Fujii, all of Ebina, Japan

[73] Assignee: Fuji Xerox Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/543,914

[22] Filed: Oct. 17, 1995

[30] Foreign Application Priority Data

Nov. 7, 1994 [JP] Japan ..... 6-272747

[51] Int. Cl.[7] ..... B41J 2/175

[52] U.S. Cl. ..... 347/87

[58] Field of Search ..... 347/85, 86, 87, 347/92, 93

[56] References Cited

U.S. PATENT DOCUMENTS

| | | | |
|---|---|---|---|
| 4,589,000 | 5/1986 | Koto et al. | 347/92 |
| 4,929,969 | 5/1990 | Morris | 347/87 |
| 5,453,771 | 9/1995 | Waseda et al. | 347/86 |
| 5,552,816 | 9/1996 | Oda et al. | 347/86 |
| 5,589,862 | 12/1996 | Ujita et al. | 347/87 |
| 5,784,088 | 7/1998 | Ujita et al. | 347/93 |

FOREIGN PATENT DOCUMENTS

| | | |
|---|---|---|
| 536 980 | 4/1993 | European Pat. Off. . |
| 50-74341 | 6/1975 | Japan . |
| 61-35892 | 3/1986 | Japan . |
| 2-187364 | 7/1990 | Japan . |
| 2-214665 | 8/1990 | Japan . |
| 3-92356 | 4/1991 | Japan . |
| 5-8405 | 1/1993 | Japan . |
| 5-238016 | 9/1993 | Japan . |
| 6-966 | 1/1994 | Japan . |

*Primary Examiner*—N. Le
*Assistant Examiner*—Judy Nguyen
*Attorney, Agent, or Firm*—Oliff & Berridge, PLC

[57] ABSTRACT

An ink printer designed to make users free from any danger when an inktank is replaced and to prevent ink from leaking out when the inktank is detached. The joint part of an inktank is pressed against the ink guide of a print head to couple the inktank and the print head together, so that ink is supplied from the inktank to the print head. The joint part is supplied with a porous material. When the inktank is attached, the porous material is compressed and contained in the joint part. When the inktank is detached from the print head, the volume of the porous material increases thereby raising its porosity. The ink remaining in the joint part is absorbed by the porous material whose porosity has been raised, so that ink is prevented from flowing out in the vicinity of the joint part when the inktank is removed.

19 Claims, 8 Drawing Sheets

INK PRINTER AND INK TANK WITH INK SPILL PREVENTION

BACKGROUND OF THE INVENTION

1) Field of the Invention

The present invention relates to an ink printer having a print head for ejecting ink onto a recording member, and an inktank, detachable from the print head, for reserving ink to be supplied to the print head therefrom, and to an inktank, and more particularly to a joint part to which the inktank is attached.

2) Description of the Related Art

Recently, ink-jet printers are utilized extensively because the ink-jet printers make printed images of good quality available with less noise. Particularly, many of the inkjet printers that have been developed so far are intended for personal use as they can be made compact in size. Such small-sized printers for personal use are designed so that users themselves are allowed to replace inktanks or ink-jet cartridges integral with print heads to produce a fresh supply of ink. In the case of a replaceable inktank in particular, a fresh supply of ink is procurable at a lower cost and the running cost is reducible accordingly.

With respect to the printer provided with such a replaceable inktank, there have been cases where ink seeps out in the surrounding area of the joint part to which the inktank is attached when the inktank is replaced and problems arising from ink leakage include causing the user to stain his fingers with ink, including ink to drip into the machine proper and so forth.

A method for solving the foregoing problems as disclosed in, for example, Published Unexamined Japanese Patent Application Hei. 3-92356 is to form an ink outlet in the underside of an inktank with a rubber tap through which a metal ink supply needle is injected to pass so as to communicate the rubber tap with an ink flow path to a print head. The ink supply needle thus arranged is rendered resistant to corrosion and the tip of a pipe is sharp-pointed so that it can pass through the rubber tap. Even when the inktank is detached, the ink supply port of the inktank is closed because of the elasticity of the rubber tap to thereby prevent ink from leaking. However, there still exits a problem in that inadvertent handling may cause the user to touch the pointed tip of the pipe, thus inflicting an injury on him. Since the inner diameter of the ink supply needle itself is small, another problem arises from an obstruction to the ink supply in the case where fragments of the rubber tap creep into the inside of the ink supply needle.

A method proposed to solve the foregoing problems, as disclosed in, for example, Published Unexamined Patent Application No. Sho. 50-74341, is to provide an inktank in which a cover plate of rubber having a through-hole is mounted to the leading end of an ink supply port, and the through-hole is sealed with a thin rubber film having a split. Consequently, a liquid guide pipe relatively less pointed can readily be inserted. In this case, however, there still arises a problem that a small amount of ink may leak out of the through-hole and through the split.

Another method for the purpose, as disclosed in, for example, Published Unexamined Japanese Patent Application Nos. Hei. 2-214665, Hei. 6-966, is provided an inktank in which an inktank connection portion is sealed with a sealing member, and a printer connection portion is formed with a rigid porous material, a protruded piece for punching being placed around the porous material. With the inktank, the sealing member of an inktank is broken with the protruded piece for punching when the inktank is attached, and the porous material is fit-pressed against a porous material within the inktank to couple both together. With this arrangement, the leading end portion of an ink supply pipe which is provided with the porous material, is relatively wide and this prevents the pipe from being clogged up. As the protruded piece for punching need not be sharp-pointed so much, there is no fear of injury. Since the inktank is initially sealed with the sealing member, no ink leakage occurs. However, the rigid porous material is always supplied with ink abundantly and a problem arising from the arrangement like this is that the ink thus supplied falls in drops when the inktank is detached.

In recent years, a variety of color ink printers are developed extensively and a single integral print head for the printers is capable of printing multi-color image. In the case of such an integral print head, ink falling in drops as well as ink leakage as described above tends to cause color ink to be mixed up.

SUMMARY OF THE INVENTION

In view of the above, an object of the present invention is to provide an ink printer and an inktank designed to prevent not only an occurrence of ink leakage but also users from being exposed to danger when the inktank is replaced and further to restrain not solely ink leakage from a joint when the inktank is detached but color mixture due to ink leakage.

According to the first aspect of the invention, an inkjet printer for ejecting an ink onto a recording member to produce an image print comprises a print head for ejecting the ink onto the recording member, an inktank, detachable from the print head, for supplying the ink to the print head therefrom, and a joint port for joining said print head to the inktank, the joint port including a porous material disposed between the print head and said inktank, wherein the porous material is variable in size so as to prevent the ink from leaking out when the inktank is detached from the print head.

According to the second aspect of the invention, an image forming apparatus for forming an image on a recording member comprises a print unit having discharge means for discharging an ink onto the recording member, an ink reservoir unit having ink storing means for storing the ink to supply the ink to the discharging means, the ink reservoir unit being detachable from the print unit and the ink storing means having a capillary member to reserve the ink therein and coupling means for coupling the print unit with the ink reservoir unit, the coupling means including porous material which is disposed away from the capillary member in such a manner that the porous material is prevented from pressing the capillary member of the inktank when the inktank is attached to the print head, porosity of the porous material increasing when the ink reservoir unit is detached from the print unit.

According to the third aspect of the invention, an inktank for supplying an ink to a print head through a port, which is detachable from said print head, comprises a porous material disposed on the port of the inktank so that the porous material is pressed when the inktank is attached to the print head, the porous material increasing in size so as to absorb an ink when the inktank is detached.

According to the fourth aspect of the invention, a print head for ejecting an ink on a recording member, to which an ink is supplied from an inktank through a port thereof, comprises a porous material disposed on the port of the print head, so that the porous material is pressed when the print head is attached to the inktank, the porous material increasing in size so as to absorb the ink when the print head is detached.

In the ink printer and the inktank according to the present invention, the porous material disposed in a joint part is compressed in comparison with what is in a free state after the inktank is attached. The ink contained in the joint part normally tends to seeps out in the surrounding area of the porous material when the inktank is detached. However, the porous material disposed in the joint part is released from being compressed almost simultaneously when the inktank is detached so as to increases its volume, whereby ink apt to flow out is absorbed by the porous material itself as the porosity of the porous material rises. Therefore, the ink existing in the joint part is restrained from leaking out, to say nothing of falling in drops. When a plurality of color inks are employed, the provision of a porous material for each color inks prevents color mixture.

A porous material to be disposed in the joint part may be provided either on the inktank side or on the opposite side to which the inktank is attached.

When the porous material is provided on the inktank side, it is tapered off toward a position in which the inktank is attached to ensure that it is held in position in compressed condition. Moreover, the surface which is not provided with the porous material but is fitted with the inktank and makes contact therewith, may be formed with a metal mesh. When the porous material is provided on the side to which the inktank is attached, it is conversely tapered toward the inktank. Further, the surface which is not provided with the porous material but makes contact therewith, may be formed with a metal mesh. The surface which is not fitted with the porous material but makes contact therewith when the inktank is attached and the surface of the porous material in contact with the former surface are made flat in both cases.

The inktank may at least have a main tank including an air hole and the through-hole for supplying ink, a capillary member contained in the main tank, a first meniscus forming member with a number of minute holes disposed in the through-hole and in contact with the capillary member, an intermediate inktank communicating with the main inktank by means of the through-hole via the first meniscus forming member, the intermediate inktank including a joint part for joining a print head to the inktank on the base of the intermediate inktank, and a second meniscus forming member disposed in the joint part. The intermediate inktank may have a portion extending to a level above the through-hole.

DESCRIPTION OF THE PREFERRED EMBODIMENTS

Figure 1:
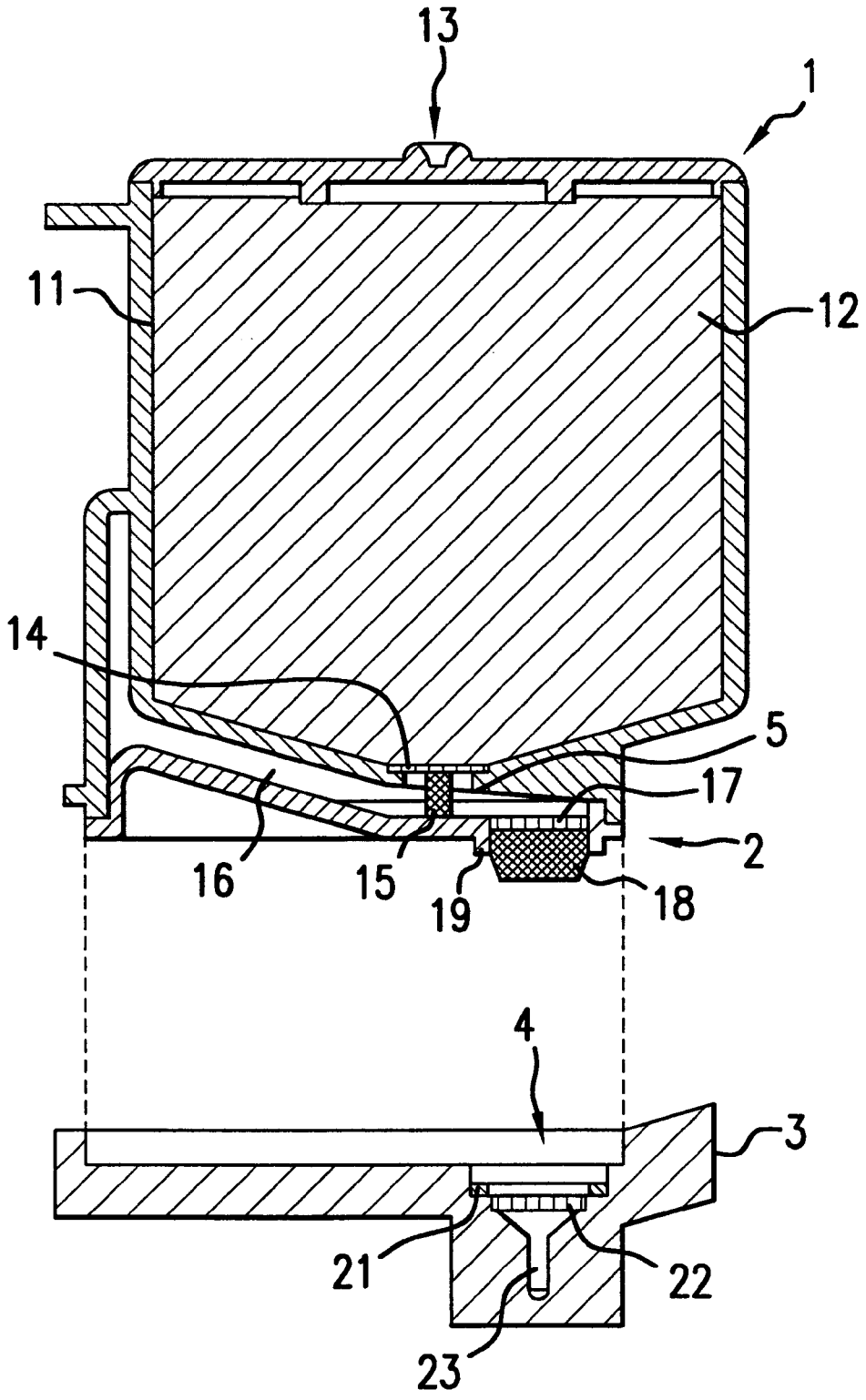
FIG. 1 is a sectional view of the principal part of an ink printer in combination with an inktank according to a first embodiment of the present invention.
Figure 2:
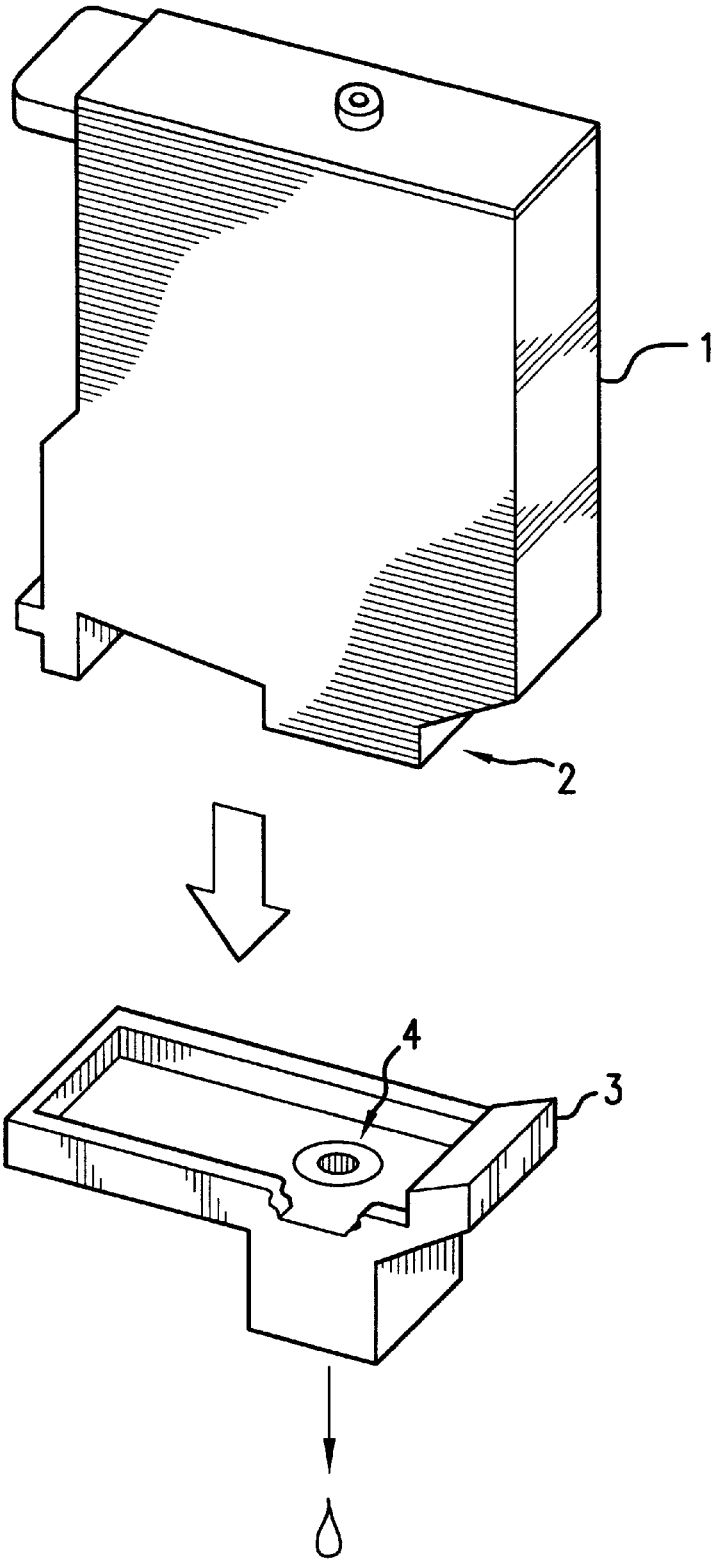
FIG. 2 is a perspective view of the principal part of the ink printer in combination with the inktank according to the first embodiment of the present invention.

FIG. 1 is a sectional view of the principal part of an ink printer and an inktank according to a first embodiment of the present invention, and FIG. 2 is a perspective view of the principal part thereof. In FIG. 1, reference numeral 1 denotes an inktank; 2, a joint part; 3, a print head; 4, an ink guide; 11, a main inktank; 12, a capillary member; 13, an air hole; 14, a first meniscus forming member; 15, an ink leading member; 16, an intermediate inktank; 17, a second meniscus forming member; 18, a porous material; 19, a joint peripheral member: 21, packing; 22, a filter; and 23, an ink flow path. FIGS. 1 and 2 show a state before the inktank 1 is attached. More specifically, FIG. 1 shows the print head 3 provided to the ink printer, whereas FIG. 2 only shows the inktank 1 and the print head 3 which are to be combined together. The inktank 1 and the print head 3 are joined together in the joint part 2. When the joint part 2 of the inktank 1 is forced to contact the ink guide 4 of the print head 3, the ink flow path is coupled so as to have ink supplied from the inktank 1.

The main inktank 11 and the intermediate inktank 16 extended from the lower portion of the main inktank 11 toward one side thereof constitute the inktank 1. The capillary member 12 is placed in the main inktank 11. The capillary member 12 is used for reserving ink by means of capillary force and retains negative pressure. An example of the capillary member 12 is felt, a urethane sponge and the like. The air hole 13 capable of communicating the capillary member 12 with atmospheric air is bored in the upper portion of the main inktank 11, whereas a through-holes is bored in the lower portion of the main inktank 11 so as to communicate with the intermediate inktank 16. Since the upper portion of the capillary member 12 is communicating with the air and opened to the atmosphere, the ink in the capillary member 12 is pressed down when it is supplied. Further, the ink is forced out from the lower portion of the capillary member 12 into the intermediate inktank 16 because of the negative pressure. Moreover, the base of the main inktank 11 forms slopes with the through-holes as the lowest part.

The through-holes formed in the base of the main inktank 11 is provided with the first meniscus forming member 14 having many microscopic holes. The base of the capillary member 12 is forced to contact the first meniscus forming member 14. In a state where the capillary member 12 has been impregnated with ink, the ink passes through the first meniscus forming member 14 and moves down to the intermediate inktank 16. When the capillary member 12 becomes short of ink, the ink kept filling up the microscopic holes of the first meniscus forming member 14 in contact with the capillary member 12 is caused to press the meniscus thereof and passes therethrough in overcoming the surface tension. The ink reduced to form is then allowed to move into the intermediate inktank 16, whereby the pressure of ink to be supplied to the print head 3 is kept at a constant level.

The ink leading member 15 is provided beneath the meniscus forming member 14 or it is otherwise acceptable to make part of the meniscus forming member 14 such an ink leading member 15. The ink leading member 15 is extended up to the base of the intermediate inktank 16. When a layer of air is produced because bubbles have collected together on the underside of the meniscus forming member 14 or when the liquid level of ink within the intermediate inktank 16 lowers, the ink leading member 15 operates to suck up the ink in the intermediate inktank 16 and supplies the ink to the first meniscus forming member 14. Thus, the first meniscus forming member 14 is always kept wet and allowed to keep up the negative pressure. Moreover, the ink supply pressure can be maintained in the best condition until the ink is used up.

The intermediate inktank 16 has an extended portion higher in position than the through-holes. In FIG. 1, that portion extends up to one side of the main inktank 11 and has a sloped upper wall extending from the lower part of the through-holes of the main inktank 11 up to the side portion of the main inktank 11. The intermediate inktank 16 is used to accumulate, in the side portion of the main inktank 11, the bubbles passed through the first meniscus forming member 14 and intruded into the intermediate inktank 16 to prevent the introduction of the bubbles from the joint part 2 into the print head 3.

The joint part 2 is provided on the base of the intermediate inktank 16 to couple the intermediate inktank 16 to the print head 3. The joint part 2 is provided with the second meniscus forming member 17 with many microscopic holes and the porous material 18 whose volume varies each time the inktank 1 is attached or detached. After the inktank 1 is detached, the surface tension of the ink formed in the microscopic holes in the second meniscus forming member 17 operates to cause the ink in the intermediate inktank 16 to leak out from the joint part 2. When the inktank 1 is attached to the print head 3, the pressure developed through the fitting action is used to pass the air left in the joint part 2 through the ink film of the second meniscus forming member 17 so as to move into the intermediate inktank 16. Therefore, the intrusion of bubbles into the print head is reducible. After the inktank 1 is attached, further, the inktank 1 is set free from undergoing vibration and shock, and from being subjected to pressure fluctuation due to acceleration. Moreover, bubbles are prevented from penetrating through the nozzle of the print head 3. An example of the second meniscus forming member 17 is a stainless mesh filter having a filter particle size of 40 $\mu$, for example.

The porous material 18 provided to the joint part 2 is adapted so that its volume when the inktank 1 is detached differs from the volume when the inktank 1 is attached. Ink existing in the joint part 2 during the time the ink is used after the inktank 1 is attached to the print head 3 is absorbed into the porous material 18 whose increased volume has resulted in increasing its capacity of reserving ink, so that the ink is prevented from dripping. The porous material 18 is made of any material whose volume is made variable by pressing force and any material excellent in ink absorbing capacity. More specifically, urethane sponge and melamine foam, for example, may be used for the purpose. With the use of these elastic material for the porous material 18, it is possible to secure an increase in volume and a rise in porosity with stability when the inktank is detached. The porous material 18 is tapered in shape and has a flat head portion, whereby inconvenience arising from a case where it is caught by the level difference of the packing can be prevented. In addition, the porous material 18 can be received in uniformly compressed condition by the coupling portion between the joint part 2 and the ink guide 4. This porous material 18 is desired to have low flow path resistance. The joint peripheral member 19 of the joint part 2 is used for covering the side of the porous material 18 and its tip is shaped to have a convex surface. The porous material 18 is provided on the second meniscus forming member 17 so as not to contact with the capillary member 12 in the inktank 1 when the inktank 1 is attached thereto. Accordingly, even if the porous material 18 is compressed when the inktank 1 is attached, air is allowed to enter into not the capillary member 12 but the intermediate chamber 16. Further, since the capillary member 12 is not subjected to compression when the inktank 1 is attached, it is possible to maintain an internal pressure condition thereof stable thereby resulting in preventing an occurrence of problems which may be caused upon attaching and detaching the inktank 1.

On the other hand, the print head 3 is coupled to the joint part 2 of the inktank 1 via the ink guide 4. The ink guide 4 is provided with, for example, doughnut-like rubber packing in such a way as to correspond to the joint peripheral member 19 of the inktank 1. The ink flow path 23 is closed when the member 19 is pressed against the packing 21 so as to prevent ink leakage in this portion. As the material of the packing 21, any material resistant to ink for use is preferred. An example of the packing 21 is silicone rubber or butyl rubber having a hardness of 30 degrees. When the joint peripheral member 19 and packing 21 also serves as a stopper so that the porous material 18 may not be deformed excessively in a lateral direction. Consequently, it becomes possible to compress the porous material 18 uniformly.

The filter 22 is arranged in the ink flow path 23 extending from the ink guide 4 up to a nozzle. The filter 22 is provided so as to prevent dust sticking to the ink guide 4 from intruding into the ink flow path 23 after the inktank 1 is detached. As the material of the filter 22, an example is a stainless mesh filter having a filter particle size ranging from 10 to 60 $\mu$. As other additional materials, a ceramic filter, for example, may be utilized. More specifically, a stainless mesh filter having a filter particle size of 20 $\mu$, for example, may be used.

Figure 3:
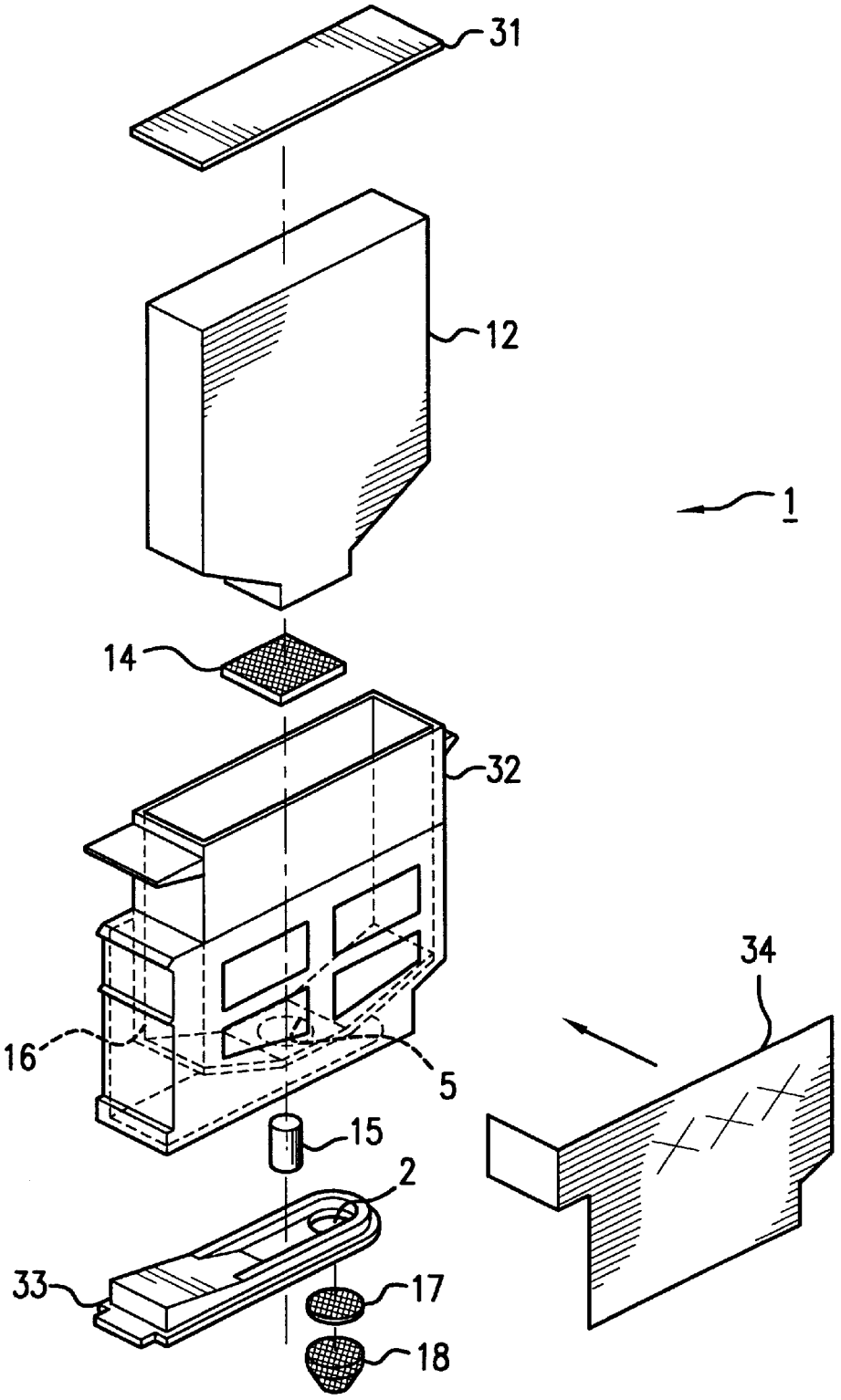
FIG. 3 is an exploded view of the inktank 1 of the ink printer according to the first embodiment of the present invention.

FIG. 3 is an exploded view of the inktank 1, wherein like reference characters designate corresponding parts in FIG. 1. In FIG. 3, reference numeral 31 denotes a top cover; 32, a tank case; 33, a bottom cover; and 34, a label. The inktank 1 is formed with the top cover 31, the tank case 32 and the bottom cover 33. The side and base of the main inktank 11, and the top and the side of the intermediate inktank 16 as shown in FIG. 1 constitute the tank case 32. A through-holes for communicating the main inktank 1 with the intermediate inktank 16 is formed in the base of the tank case 32, and the first meniscus forming member 14 is provided in the through-holes. Further, the capillary member 12 is inserted in the tank case 32. The top cover 31 having the air hole is provided on the tank case 32 to form the main inktank 16. The ink leading member 15 is provided beneath the first meniscus forming member 14, and the bottom cover 33 is provided beneath the ink leading member 15. Thus the intermediate inktank is formed. The joint part 2 is formed in the bottom cover 33, whereas the second meniscus forming member 17 and the porous material 18 are arranged in the joint part 2. Incidentally, a label 34 carrying a guide item may be attached to the side of the tank case 32.

Figure 4:
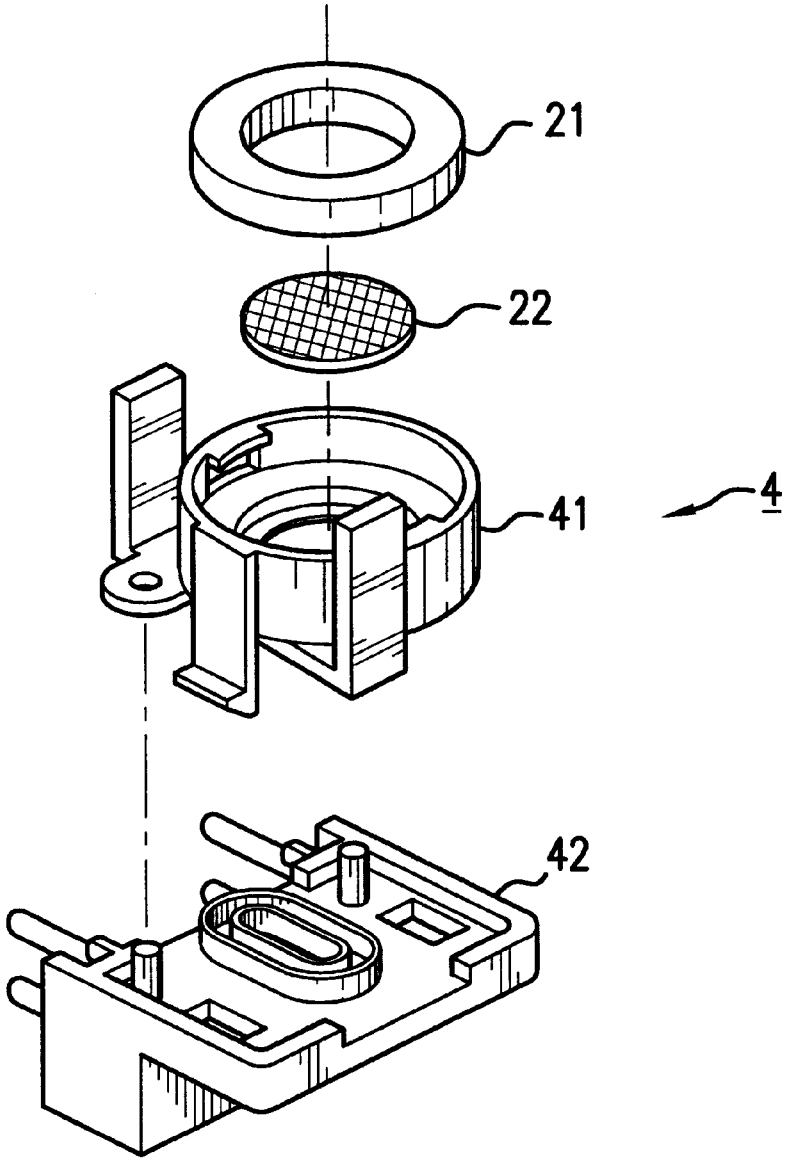
FIG. 4 is an enlarged exploded view of an ink guide 4 of the ink printer in combination of the inktank according to the first embodiment of the present invention.

FIG. 4 is an enlarged exploded view of the ink guide 4, wherein like reference characters designate corresponding parts in FIG. 1. Reference numeral 41 denotes a joint block; and 42, a manifold. As noted previously, the ink guide 4 is provided with the packing 21 and the filter 22, which are fitted to the joint block 41 to fabricate a joint block assembly. Moreover, the manifold 42 incorporates a head chip having nozzles for ejecting ink, so that the ink flow path for use in supplying ink to the head chip. Further, the head chip is provided with heating elements each corresponding to the nozzles to produce bubbles for causing ink to be discharged. The joint block assembly is attached to the manifold 42 to form the principal part of the print head 3. In addition, the print head 3 is so wired as to supply power and a control signal to the head chip incorporated in the manifold 42, and provided with a drive circuit for driving each heating element in conformity with an image to be recorded.

Figure 5:
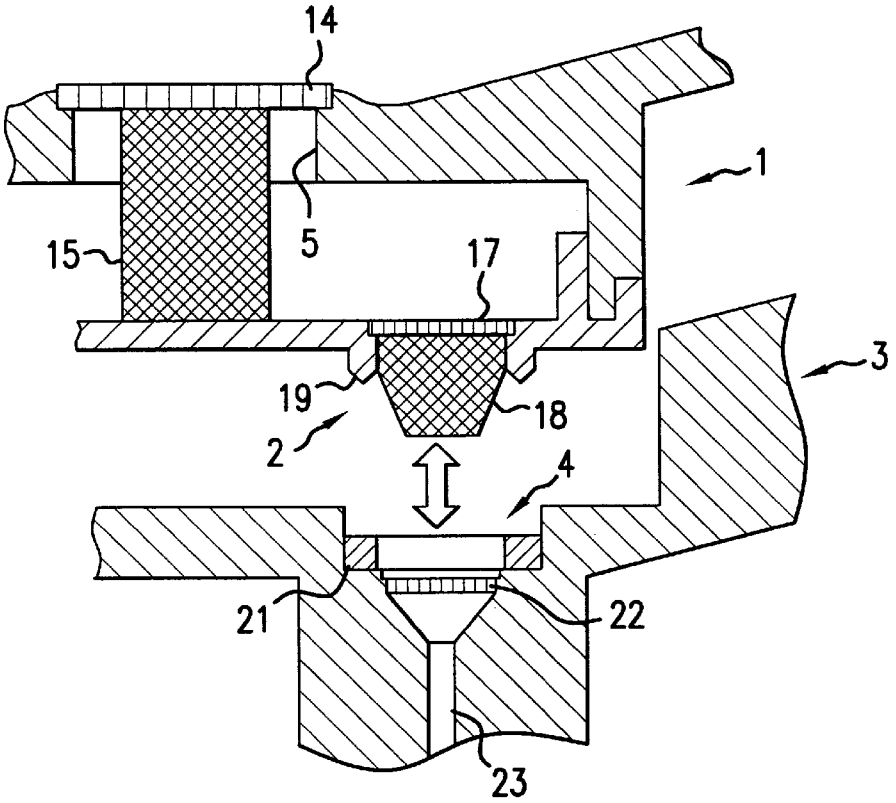
FIG. 5 is an enlarged sectional view in the vicinity of a joint part after the inktank is removed from the ink printer in combination of the inktank according to the first embodiment of the present invention.
Figure 6:
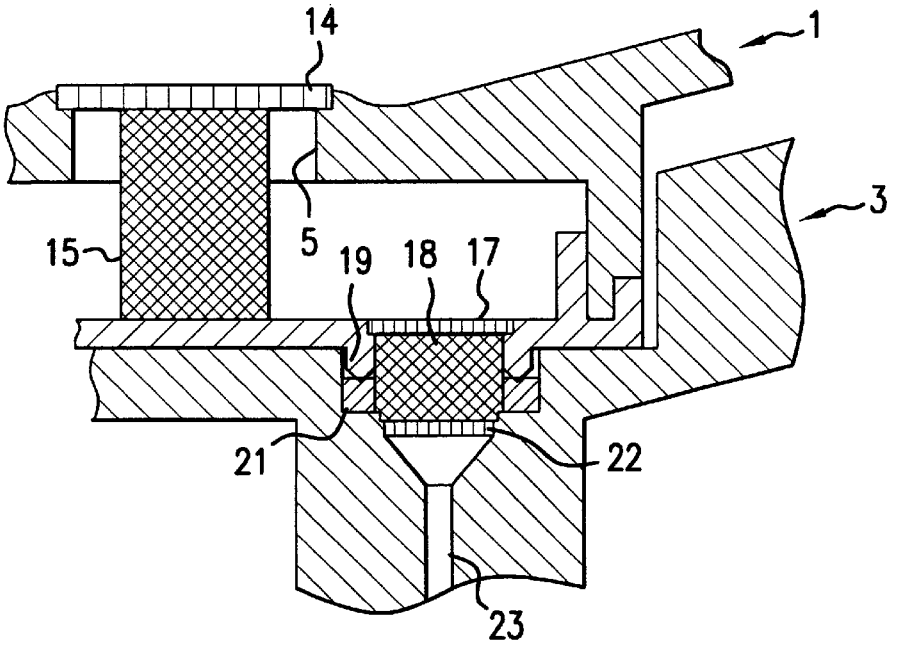
FIG. 6 is an enlarged sectional view in the vicinity of the joint part after the inktank is attached to the ink printer in combination of the inktank according to the first embodiment of the present invention.

FIG. 5 is an enlarged sectional view in the vicinity of the joint part after the inktank is removed from the ink printer in combination of the inktank according to the first embodiment of the present invention. FIG. 6 is an enlarged sectional view in the vicinity of the joint part after the inktank is attached to the ink printer. Reference characters in FIGS. 5 and 6 are the same as those shown in FIG. 1. As shown in FIG. 6, the porous material 18 provided in the joint part 2 abuts against the filter 22 provided in the ink guide 4 and remains to be compressed after the inktank 1 is attached. Moreover, the convex surface at the tip of the joint peripheral member 19 is forced to contact the packing 21 so as to form the ink flow path while keeping hermetic condition. Ink within the inktank 1 is passed through the compressed porous material 18 before being supplied to the print head 3. Although the porous material 18 is kept in the compressed condition at that time, it is not intended to increase the capillary force and to store the ink.

Since the joint part 2 makes an ink flow path, ink remains in this part. After the inktank 1 is removed, ink remaining in the joint part 2 normally tends to flow around the joint part 2. However, the built-in porous material 18 of the joint part 2 is released from being compressed almost simultaneously when the inktank is detached as shown in FIG. 5, and its volume itself increases. As the volume of the porous material 18 increases, its porosity also increases and absorbs the ink induced to flow out of the joint part 2. Thus, ink remaining in the joint part 2 is restrained from leaking out of the joint part 2. Moreover, the adoption of an elastic material, for example, urethane sponge as the porous material 18 makes it possible to increase the volume of the porous material and raise the porosity thereof with stability when the inktank is detached.

With the inktank as described with reference to FIG. 6, the porous material 18 protrudes from the joint peripheral member 19 after the inktank 1 is removed. In this case, the user may touch the porous material 18 and have an ink stain. In order to prevent such an incident, such a modification is possible as making the joint peripheral member 19 large enough to cover the periphery of the porous material 18 or arranging a protective plate around the member 19. Moreover, the porous material 18 is protected by means of a cap at the time the inktank 1 is shipped to restrain ink from evaporating out of this portion.

Figure 7:
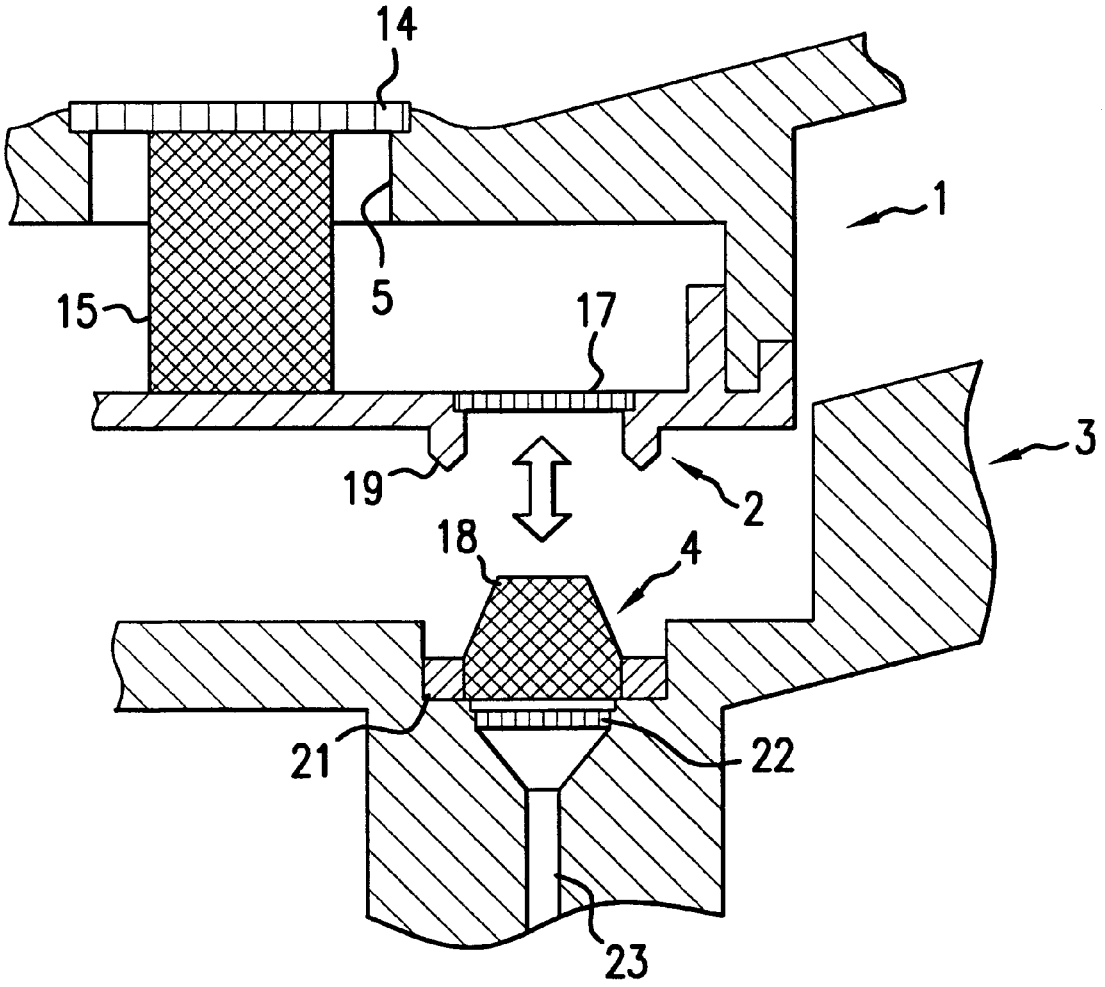
FIG. 7 is an enlarged sectional view in the vicinity of a joint part in an ink printer according to a second embodiment of the present invention.

FIG. 7 is an enlarged sectional view in the vicinity of a joint part 2 in an ink printer according to a second embodiment of the present invention, wherein reference characters designate corresponding parts in FIG. 1. According to this embodiment, the porous material 18 is provided on the side of the print head 3. With this arrangement, the porous material 18 is also compressed by the second meniscus forming member 17 as shown in FIG. 6 after the inktank is attached. After the inktank 1 is removed, the porous material 18 expands to increase its volume so as to absorb ink remaining in the joint part 2, whereby the ink is prevented from leaking out of the joint part 2.

Figure 8:
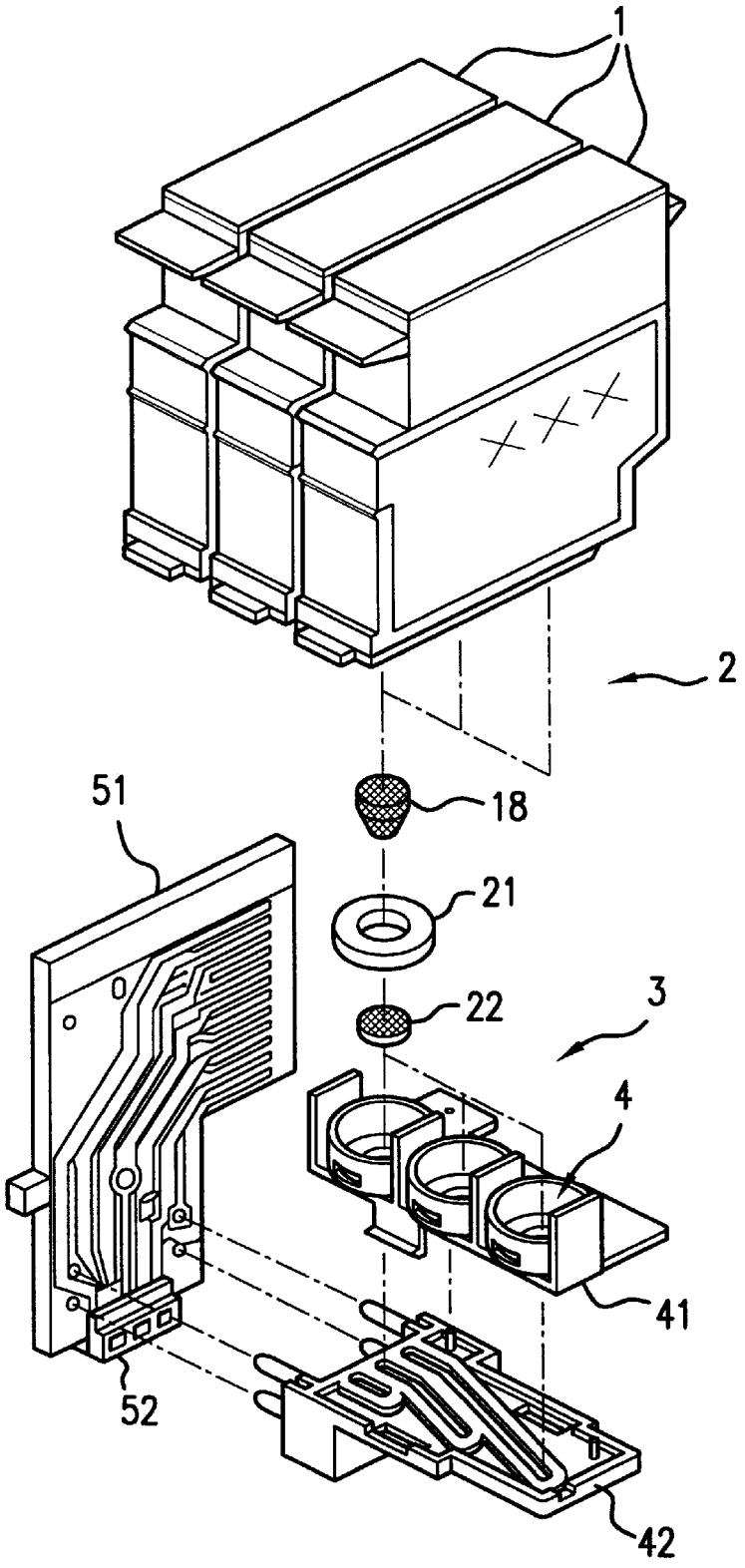
FIG. 8 is a block diagram of the principal part of an ink printer according to a third embodiment of the present invention.

FIG. 8 is a block diagram of the principal part of an ink printer according to a third embodiment of the present invention, wherein like reference characters designate corresponding parts in FIGS. 1 through 4 with the omission of the description thereof. In FIG. 8, which shows an inktank according to the present invention for a multi-color image ink-jet printer, reference numeral 51 denotes a printed circuit board; and 52, a head chip. According to this embodiment, ink of three colors is supplied independently from the corresponding inktank 1. For example, cyan, magenta and yellow may be used. Needless to say, the application of the present invention is not limited to these colors. Moreover, four colors including primary three colors and black, two colors or more than four colors are usable. The number of inktanks for use is set equal to that of colors in these cases.

The three inktanks 1 each contain ink of different colors. Each inktank is similar in construction to those shown in FIGS. 1 and 3. The porous material 18 is provided for the joint part 2 of each inktank.

An exploded view of the print head 3 is shown in FIG. 8. A joint block 41 has three ink guides 4 so as to receive inktanks containing ink of respective colors. Each of the ink guides 4 is provided with the filter 22 and the packing 21 likewise as shown in FIG. 4. The joint parts 2 of the three inktanks 1 are each pressed against the corresponding ink guides 4. Then the protruded piece of each inktank 1 is simultaneously pressed against the packing 21 to form the ink flow path.

The ink flow paths intended for the respective colors are formed in the manifold 42. Moreover, the manifold 42 and the head chip 52 are coupled together from a liquid standpoint, and the ink flow path thus formed is used for supplying the ink introduced from the ink guide 4 to the head chip 52.

The printed circuit board 51 is so wired, for example, as to supply power, a control signal, a recording image signal and the like to the head chip 52. A drive circuit for driving a heating element and the like may be provided in agreement with an image to be recorded. The printed circuit board 51 and the head chip 52 are electrically connected by, for example, wire bonding.

Figure 9:
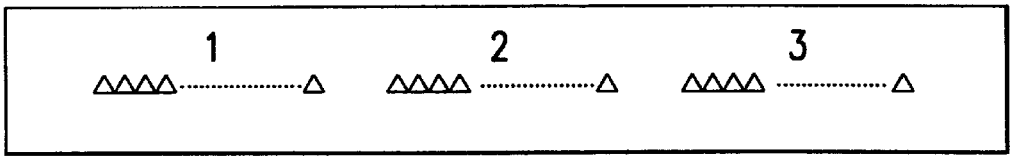
FIG. 9 is an elevational view showing an example of a head chip in an ink printer according to the third embodiment of the present invention.

FIG. 9 is an elevational view showing an example of the head chip according to the third embodiment of the present invention. The head chip 52 is provided with a plurality of nozzles arranged on a color basis and the plurality of nozzles are used for sending out jets of ink of each color. In this example, a group of nozzles for each color are disposed in a row. While the head chip 52 is moving up and down so as to control a jet of ink as shown in FIG. 9, a belt-like area of each color can be recorded. A drive circuit for driving each nozzle may be mounted on the head chip 52.

According to the third embodiment of the present invention, ink existing in the vicinity of the ink guide 4 provided for each color is prevented from leaking out or falling in drops when the inktank 1 is detached, because the ink is absorbed by each of the porous materials 18.

Therefore, ink of different color is restrained from entering adjacent ink guides 4 thereby causing an occurrence of undesired color mixture. Even according to the third embodiment like the second embodiment of the present invention, the porous material 18 may be provided in each ink guide 4.

Figure 10:
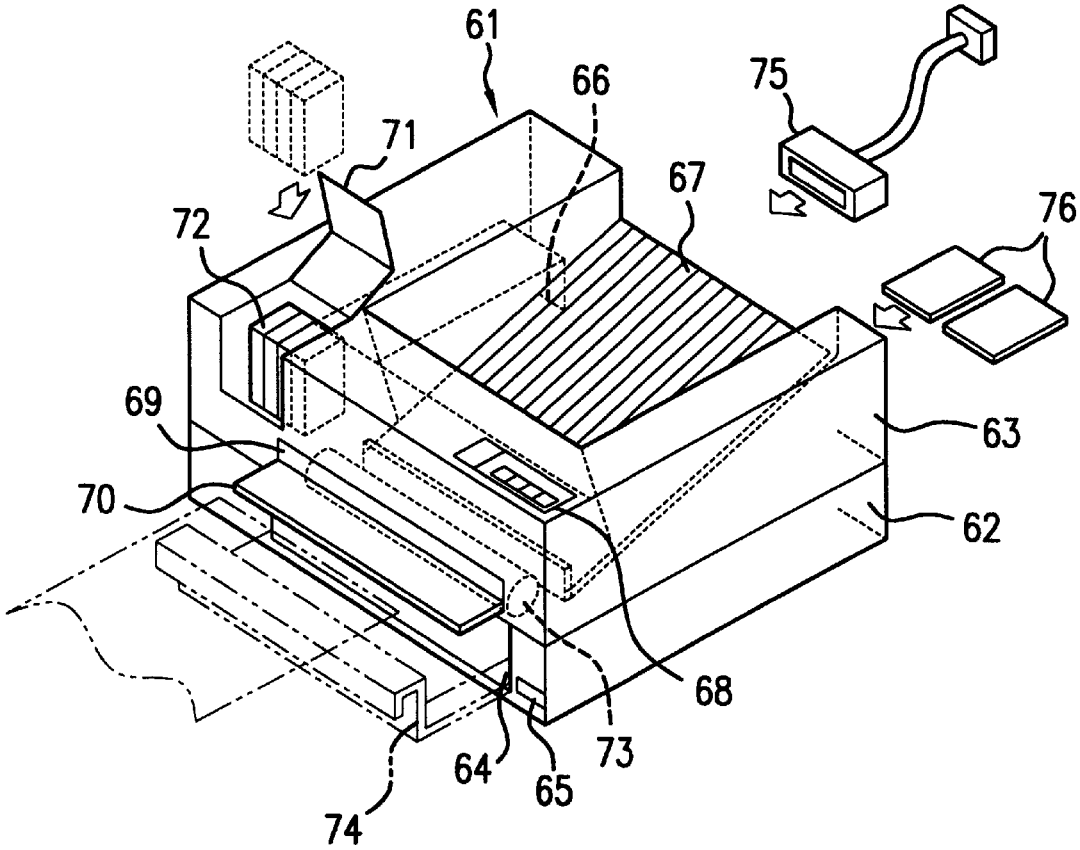
FIG. 10 is an external view of an example of an ink printer according to the present invention.

FIG. 10 is an external view of an example of an ink-jet printer according to the present invention. In FIG. 10, reference numeral 61 denotes an ink-jet printer; 62, a lower case; 63, an upper case; 64, a tray insertion port; 65, a dip switch; 66, a main switch; 67, a recording paper receiver; 68, a console panel; 69, a manual paper insertion port; 70, a manual insertion tray; 71, an inktank insertion cover; 72, an inktank; 73, a paper feed roller; 74, a paper tray; 75, an interface cable; and 76, memory cards. FIG. 10 shows an overall ink printer to which the first through third embodiments of the present invention can be applicable.

The casing of the ink printer 61 substantially comprises the lower and upper cases 62, 63 in which electric circuits and drive system parts (not shown) are contained. The lower case 62 is provided with the tray insertion port 64 through which the paper tray 74 accommodating recording paper is inserted so as to set recording paper in the ink printer 61.

Further, the dip switch 65 and the main switch 66 are attached to the lower case 62. The dip switch 65 is used for partially setting the operation of the ink printer 61 and setting functions less frequently altered are assigned thereto. While the dip switch 65 is not used, it is covered with a cover. The main switch 66 is used for turning on/off the ink printer 61. The lower case 62 is supplied with an interface connector and a port (not shown) for the memory cards 76. The interface cable 75 is connected to the interface connector so as to exchange data with an external computer. The memory cards 76 are used as an expansion memory during the time the ink printer 61 is operated or stored with fonts used for recording purposes in some case.

The paper receiver 67 is formed in the upper case 63 and used for discharging recorded paper. Further, the console panel 68 includes an input means to be used by users for giving instructions as to recording mode setting, recording paper feeding, recording paper discharging and the like, and a display means for displaying messages from the printer side. Further, the manual insertion port 69 and the manual insertion tray 70 are provided so that users can feed recording paper manually.

The inktank insertion cover 71 is provided for the upper case 63. By opening this cover, the inktank 72 inside can be attached and detached. The inktank 72 is one of any kind mentioned above in each embodiment of the present invention. Four inktanks 72 are installed and attached to a print head (not shown) in this case. Moreover, the print head is attached to a carriage (not shown). When the inktank 72 is detached, ink is not allowed to leak out or fall in drops as the ink in the vicinity of the joint part and the ink guide is absorbed by a porous material as aforementioned. Therefore, the ink is prevented from soiling the printer body and colors are from prevented from mixing because of ink falling in drops into an ink guide of a different color.

The recording paper accommodated in the paper tray 74 is taken out and conveyed sheet by sheet by a conveyor system inside (not shown) along the circumference of the paper feed roller 73. The print head (not shown) fitted with the inktank 72 is moved in a direction perpendicular to the direction in which the recording paper is conveyed to record characters and the like on a belt-like area basis. Then the paper feed roller 73 feeds the recording paper up to the recording position in the following belt-like area in the longitudinal direction of the recording paper. This operation is repeated so as to record characters and the like on the recording paper. Subsequently, the recording paper is discharged onto the paper receiver 67 of the upper case 63.

Although a description has been given of the case where the inktank 1 has the intermediate inktank 16 in each embodiment, the present invention is not limited to those embodiments but is able to render the same effect achievable even though an inktank different in structure, such as a single-chamber inktank, is installed. Further, although a description has been given of the case where the inktank 1 is attached to the print head 3 in each embodiment of the present invention, the print head 3 may also be made detachable from the carriage of the ink printer with the inktank 1 attached to the carriage. In this case, porous materials are each arranged in the joint part between the inktank 1 and the carriage and in the joint part between the carriage and the print head 3 to make these joint parts absorb the residual ink so as to prevent ink leakage.

As set forth above, according to the present invention, the porous material is made to absorb the residual ink in the joint part to prevent ink from falling in drops, leaking and flowing out of the joint part when the print head is detached from the inktank, since the joint part between the print head and the inktank is supplied with the porous material whose volume is variable. In the case where the present invention is applied to a color ink-jet printer, it is also possible to prevent color mixture due to ink falling in drops, leaking and flowing out of the joint part. Further, the joint part between the print head and the inktank is formed with the filter and the porous material with the effect of ensuring the safety of users at the time the inktank is replaced.

What is claimed is:

1. An inkjet printer for producing an image on a recording medium, comprising:

a print head for ejecting ink onto the recording medium;

an ink tank including a main ink tank and an intermediate ink tank;

a capillary member disposed within the main ink tank;

an ink leading member through which the main ink tank communicates with the intermediate ink tank, the ink leading member is disposed only in a passage through which the main ink tank communicates with the intermediate ink tank and in the intermediate ink tank;

a first meniscus forming member disposed between and contacting each of the capillary member and the ink leading member;

a joint portion defining a hole formed in the intermediate ink tank, the intermediate ink tank communicating with the print head through the hole;

a second meniscus forming member disposed within the hole;

a third meniscus forming member disposed on the print head; and a porous material disposed between the second meniscus forming member and the third meniscus forming member, the porous material permits ink flow through the porous material when the print head is attached to the intermediate ink tank, and the porous material absorbs excess ink in the joint portion when the print head is detached from the intermediate ink tank.

2. The inkjet printer of claim 1, wherein the porous material is fixed onto the second meniscus forming member.

3. The inkjet printer of claim 1, wherein the porous material is positioned on the third meniscus forming member.

4. The inkjet printer of claim 1, wherein the porous material includes a flat first end and a flat second end opposite to the first end, the first end flatly contacts the second meniscus forming member and the second end flatly contacts the third meniscus forming member.

5. The inkjet printer of claim 1, wherein the ink leading member is spaced from and not in contact with the capillary member.

6. The inkjet printer of claim 1, wherein the ink leading member absorbs ink and supplies the ink to the first meniscus forming member so as to wet the first meniscus forming member.

7. An inkjet printer for producing an image on a recording medium, comprising:

a print head for ejecting ink onto the recording medium;

an ink tank including a main ink tank and an intermediate ink tank;

a capillary member disposed within the main ink tank;

an ink leading member through which the main ink tank communicates with the intermediate ink tank;

a first meniscus forming member disposed between and contacting each of the capillary member and the ink leading member;

a joint portion defining a hole formed in the intermediate ink tank, the intermediate ink tank communicating with the print head through the hole;

a second meniscus forming member disposed within the hole;

a third meniscus forming member disposed on the print head;

a porous material disposed between the second meniscus forming member and the third meniscus forming member, the porous material permits ink flow through the porous material when the print head is attached to the intermediate ink tank, and the porous material absorbs excess ink in the joint portion when the print head is detached from the intermediate ink tank; and a recess formed in the print head and a packing disposed in the recess for receiving the porous material.

8. The inkjet printer of claim 7, wherein the porous material is fixed onto the second meniscus forming member.

9. The inkjet printer of claim 7, wherein the porous material is positioned on the third meniscus forming member.

10. The inkjet printer of claim 7, wherein the porous material includes a flat first end and a flat second end opposite to the first end, the first end flatly contacts the second meniscus forming member and the second end flatly contacts the third meniscus forming member.

11. The inkjet printer of claim 7, wherein the porous material has a first volume when the print head is attached to the intermediate ink tank, and the porous material has a second volume greater than the first volume when the print head is detached from the intermediate ink tank.

12. The inkjet printer of claim 7, wherein the ink leading member is disposed only in a passage through which the main ink tank communicates with the intermediate ink tank and in the intermediate ink tank, and the ink leading member is spaced from and not in contact with the capillary member.

13. The inkjet printer of claim 7, wherein the ink leading member absorbs ink and supplies the ink to the first meniscus forming member so as to wet the first meniscus forming member.

14. An inkjet printer for producing an image on a recording medium, comprising:

a print head for ejecting ink onto the recording medium;

an ink tank including a main ink tank and an intermediate ink tank;

a capillary member disposed within the main ink tank;

an ink leading member through which the main ink tank communicates with the intermediate ink tank, the ink leading member is disposed only in a passage through which the main ink tank communicates with the intermediate ink tank and in the intermediate ink tank;

a first meniscus forming member disposed between and contacting each of the capillary member and the ink leading member such that the ink leading member is spaced from and not in contact with the capillary member, and the ink leading member absorbs ink and supplies the ink to the first meniscus forming member so as to wet the first meniscus forming member;

a joint portion defining a hole formed in the intermediate ink tank, the intermediate ink tank communicating with the print head through the hole;

a second meniscus forming member disposed within the hole;

a third meniscus forming member disposed on the print head;

a porous material disposed between the second meniscus forming member and the third meniscus forming member, the porous material permits ink flow through the porous material when the print head is attached to the intermediate ink tank, and the porous material absorbs excess ink in the joint portion when the print head is detached from the intermediate ink tank; and a recess formed in the print head and a packing disposed in the recess for receiving the porous material.

15. The inkjet printer of claim 14, wherein the porous material is fixed onto the second meniscus forming member.

16. The inkjet printer of claim 14, wherein the porous material is positioned on the third meniscus forming member.

17. The inkjet printer of claim 14, wherein the porous material includes a flat first end and a flat second end opposite to the first end, the first end flatly contacts the second meniscus forming member and the second end flatly contacts the third meniscus forming member.

18. The inkjet printer of claim 14, wherein the porous material has a first volume when the print head is attached to the intermediate ink tank, and the porous material has a second volume greater than the first volume when the print head is detached from the intermediate ink tank.

19. An inkjet printer for producing an image on a recording medium, comprising:

a print head for ejecting ink onto the recording medium;

an ink tank including a main ink tank and an intermediate ink tank;

a capillary member disposed within the main ink tank;

a first meniscus forming member contacting the capillary member, the first meniscus forming member includes an ink leading member portion through which the main ink tank communicates with the intermediate ink tank, and the ink leading member is disposed only in a passage through which the main ink tank communicates with the intermediate ink tank and in the intermediate ink tank;

a joint portion defining a hole form ed in the intermediate ink tank, the intermediate ink tank communicating with the print head through the hole;

a second meniscus forming member disposed within the hole;

a third meniscus forming member disposed on the print head; and a porous material disposed between the second meniscus forming member and the third meniscus forming member, the porous material permits ink flow through the porous material when the print head is attached to the intermediate ink tank, and the porous material absorbs excess ink in the joint portion when the print head is detached from the intermediate ink tank.

* * * * *